United States Patent [19]

Hultman et al.

[11] 4,218,284

[45] Aug. 19, 1980

[54] PROCESS FOR THE INHIBITION OF THE FORMATION OF DEPOSITS IN CELLULOSE PULPING AND CELLULOSE PULP TREATING PROCESSES

[75] Inventors: Bengt G. Hultman, Domsjo; Rolf C. Nilsson, Ornskoldsvik, both of Sweden

[73] Assignee: Mo och Domsjo Aktiebolag, Ornskoldsvik, Sweden

[21] Appl. No.: 902,321

[22] Filed: May 3, 1978

[30] Foreign Application Priority Data

Jul. 25, 1977 [SE] Sweden ..... 7708523

[51] Int. Cl.[2] ..... D21C 11/00

[52] U.S. Cl. ..... 162/38; 162/39; 162/45; 162/79

[58] Field of Search ..... 162/38, 39, 65, 79, 162/45, DIG. 4

[56] References Cited

U.S. PATENT DOCUMENTS

| | | | |
|---|---|---|---|
| 1,860,431 | 5/1932 | Richter | 162/79 |
| 2,601,110 | 6/1952 | Fisher | 162/79 |
| 3,472,732 | 10/1969 | Bodenheimer | 162/79 |
| 3,790,637 | 2/1974 | Yang | 162/65 |
| 3,963,561 | 6/1976 | Richter | 162/65 |
| 4,045,279 | 8/1977 | Nagano | 162/65 |
| 4,050,981 | 9/1977 | Jamieson et al. | 162/79 |

FOREIGN PATENT DOCUMENTS

| | | | |
|---|---|---|---|
| 2022866 | 12/1970 | Fed. Rep. of Germany | 162/65 |
| 2540919 | 4/1976 | Fed. Rep. of Germany | 162/65 |
| 2333892 | 7/1977 | France | 162/79 |

*Primary Examiner*—S. Leon Bashore
*Assistant Examiner*—Steve Alvo

[57] ABSTRACT

A process is provided for inhibiting the formation of deposits in the course of pulping lignocellulosic material and in the treating of cellulose pulp, by addition to the cellulose pulping or treating process of compounds of polyvalent metals capable of complexing deposit-forming anions, thereby maintaining the deposit-forming anions in the form of a liquor-soluble complex.

14 Claims, 7 Drawing Figures

PROCESS FOR THE INHIBITION OF THE FORMATION OF DEPOSITS IN CELLULOSE PULPING AND CELLULOSE PULP TREATING PROCESSES

The formation of insoluble deposits in the course of cellulose pulping and treating processes has long posed a serious difficulty. Such deposits in the vessels and flow passages of the pulping and treating apparatus interfere with flow, and require shutdown of the system in order to remove them, which of course increases labor and operating costs. The problem arises because of the presence of certain deposit-forming anions in the aqueous liquors, which contain not only the pulping and treating chemicals but also dissolved and modified organic substances derived from the lignocellulosic material. Exemplary such substances present in the form of anions are the organic acids such as oxalic acid and/or other dicarboxylic acids derived from cellulose by hydrolysis and other degradation reactions. Oxalic acid poses a difficult deposit problem, because of its tendency in the presence of calcium ions to form hard smooth deposits of calcium oxalate, similar to porcelain in appearance, and equally difficult to remove, by dissolution or mechanical abrasion.

Oxalic acid is almost always formed in the chemical reactions that take place in the pulping and bleaching of lignocellulosic material. *Cellulose Chemistry and Technology* 10:4471–477 (1976) shows that oxalic acid is formed in the soda pulping process as well as in the alkaline oxygen pulping of wood. *TAPPI* 59:9 118–120 (1976) and *Svensk Papperstidning* 79:3 90–94 (1976) show that oxalic acid is also formed in the sulfate and oxygen/bicarbonate pulping of wood, and in the oxygen-alkali bleaching of cellulose pulp. Oxalic acid is also found in the spent liquor from the peroxide bleaching of groundwood pulp, *Cellulose Chemistry and Technology* 8:6 607–613 (1974).

If the treating and pulping liquors are acidic, the oxalate ions exist as oxalic acid and as hydrogen oxalate, which are water-soluble. However, if the pH is or becomes alkaline, insoluble metal oxalates, such as calcium oxalate from metal cations present in the liquor, precipitate. Calcium oxalate deposits are very hard, and can be difficult to remove after they have been formed, particularly after ageing. Frequently, cooking with nitric acid combined with mechanical abrasion is required, to break up and dissolve such deposits. The use of nitric acid results in the evolution of copious quantities of nitrogen oxides, while the oxalate is broken down to carbon dioxide, posing an emissions problem, as shown by the following reactions:

$$2HNO_3 + CaC_2O_4(s) \rightarrow Ca^{2+} + 2NO_3^- + H_2C_2O_4 \quad (I)$$

$$2HNO_3 + H_2C_2O_4 \rightarrow 2NO_2\uparrow + 2CO_2\uparrow + 2H_2O \quad (II)$$

The nitric acid frequently has to be used in the form of hot concentrated nitric acid, and this in addition to the toxic nitrogen oxide fumes formed makes the treatment with nitric acid very difficult to handle.

It has also been proposed that the deposits be dissolved by washing with chelating agents. The chelating agents most frequently used are EDTA (ethylene diamine tetraacetic acid), DTPA (diethylene triamine pentaacetic acid) and NTA (nitrilotriacetic acid). These chelating agents form very stable complex compounds or ions with calcium, resulting in the dissolution of the calcium from the calcium oxalate precipitate, and consequently the disintegration of the precipitate. However, such chelating agents are expensive, and have to be recovered, for economic operation. They are primarily useful in removing deposits that have already been formed, since they cannot be added continuously to prevent the formation of deposits because of their cost, and thus their use does not resolve the deposit problem.

It is also known that the deposits can be dissolved by addition of polyphosphates, forming a soluble calcium polyphosphate complex in similar manner to the calcium chelates, *Pulp and Paper Magazine of Canada* 54:3 239–246 (1953). However, if the concentration of calcium is high, very large amounts of polyphosphates are required, resulting in excessive cost. However, because the polyphosphates are not destroyed in the soda boiler, polyphosphates can be recovered in the chemicals recovery and recycled.

The use of chemicals for deposit removal is not absolutely required. It is possible to remove the deposits solely by mechanical means. This however requires application of mechanical means throughout the area where the deposits are formed, and since some of these areas may be difficult of access, mechanical techniques are of limited application. Moreover, after they have been loosened and broken up, the deposits must be washed out and disposed of so that the cleanup time required may be greater than when chemical methods or when a combination of chemical and mechanical methods are used.

The formation of deposits in the equipment in cellulose pulping and treating mills, particularly in the evaporating apparatus, has been recognized as a serious problem for a long time. Rydholm *Pulping Processes* devotes much attention to the deposit problem at pages 768–776 in connection with the evaporation of spent liquors from sulfate and sulfite pulping processes, and recommends that the chemical method with nitric acid be combined with mechanical cleaning, in order to remove the deposits.

The deposit problem is also discussed by Ulfsparre in *Svensk Papperstidning* 61 803–810 (1958). Ulfsparre observes that avoiding, or at least decreasing, deposit formation on surfaces which are heated during evaporation is a practical problem of primary importance for the cellulose pulping industry, which has to be solved. At page 804, Ulfsparre states that the deposits formed necessarily must be continuously dissolved, in order to maintain production capacity in the equipment, i.e., by reducing the blockages and flow restrictions.

Regnfors *Svensk Kemisk Tidskrift* 74:5 236–250 (1962) states that deposit difficulties in the evaporation of waste sodium sulfite pulping liquor are as serious as for calcium sulfite pulping liquor, depending of course upon the amount of calcium ion introduced from the wood. Similarly, serious deposit difficulties will occur in sulfite pulping mills working on magnesium base.

In spent bleaching liquors, the problems related to the formation of calcium oxalate deposits can be more serious than in chemical pulping processes, since larger amounts of oxalates are formed during bleaching than during pulping. Even if the calcium content of liquors obtained from pulp bleaching processes is not very high, both sulfite and sulfate spent pulping liquors contain calcium from the wood, which means that the conditions for formation of calcium oxalate are fully met when the spent bleaching liquor is reintroduced into the stream of spent pulping liquor, before evaporation and combustion. In the sulfate pulping process, moreover, calcium derived from the causticizing stage is also a contributing factor.

Deposit problems in practice mainly occur in the washing section and in the evaporation stage, since normally the main part of the spent bleaching liquor is recycled to the washing stage.

Despite the attention of many workers in the cellulose pulping and treating field, the deposit problem has not been solved, and it has therefore been necessary to shut down pulping and treating equipment at regular intervals for removal of the deposits by chemical and/or mechanical methods.

Swedish Pat. No. 367,848 proposes a process for preventing deposit formation in which the lignocellulosic material is preheated and made alkaline at a pH of 10 or greater, so that dissolution of the calcium salts in the wood in the course of the pulping and other treatment is reduced. This process is of practical use only in the alkaline pulping stages of the sulfate or neutral sulfite pulping processes, and does not in any case completely eliminate the deposit problem.

In accordance with the present invention, a process is provided for inhibiting the formation of deposits in cellulose pulping and cellulose pulp treating processes, thereby reducing or even eliminating the need for shutdown of equipment for cleaning, by addition of a compound of a polyvalent metal capable of forming liquor-soluble complexes and thus retaining the deposit-forming anions in solution in the cellulose pulping or cellulose pulp treating liquor. The polyvalent metal compound is added in an amount to provide a sufficient quantity of complexing polyvalent metal cation in the liquor so that the deposit-forming anions are kept in solution in the form of a liquor-soluble complex with the polyvalent metal cation. While any complex-forming polyvalent metal cations such as nickel, copper, cobalt, cadmium, zinc, manganese, iron and aluminum can be employed, the preferred polyvalent metal cations are aluminum and iron. Aluminum is most preferred when precipitation of iron hydroxide and/or iron sulfide must be avoided. Combinations of iron and aluminum compounds can be added, and are particularly advantageous in many cases.

The deposits formed in chemical cellulose pulping processes pose a particularly irksome problem, and consequently the process of the invention is of especial application to cellulose pulping processes, and in particular to the chemicals recovery stages in cellulose pulping processes. In such processes, the polyvalent metal compound can be added to the spent liquor from the pulping stage, and it will then be present during the chemicals recovery stage, and can be recycled with the recovered chemicals. Thus, the compound will be present in the pulping liquor in the course of the pulping, and can inhibit the formation of deposits during all pulping and recovery stages of the pulping process. This technique is applicable to the sulfite and sulfate pulping processes, as well as sulfur-free pulping processes, such as soda cooking. When the process is applied to sulfite pulping using a sodium sulfite base, employing a recovery system according to the STORA process, it has been found to be especially advantageous to add an aluminum compound as the polyvalent metal compound. This results in precipitation of aluminum hydroxide, and this can be dissolved in alkali and recycled to the spent pulping liquor before its evaporation. In this way, the polyvalent metal compound is recovered and recycled in the process of the invention.

If polyvalent metal cations are added to oxidized green or white liquor, the formation of deposits in the evaporation of the resulting spent bleaching liquor is avoided when this is transferred to the chemicals recovery system, and combusted in the soda boiler. Spent bleaching liquors in cellulose pulping mills pose special pollution problems, and consequently much effort has been made to recycle spent bleaching liquors to the chemicals recovery system. The use of a polyvalent metal compound makes it possible to recover and recycle the chemicals from spent bleaching liquors without the formation of deposits.

In pulp mills which utilize alkaline-oxygen bleaching, oxidized white liquor is frequently used as the source of alkali. When polyvalent metal cation such as $Al^{3+}$ is added in accordance with the present invention to the alkaline-oxygen bleaching liquor before its evaporation, the white liquor will contain aluminum in the form of aluminate ions. The addition of oxidized white liquor which contains aluminate ions to the bleaching stage results in the complexing of oxalate anion formed in the oxygen stage, which prevents deposit formation.

It is also possible to add polyvalent metal cation directly to the bleaching stages in which oxalic acid is formed. In this event, the addition of polyvalent cation should be controlled so that no precipitate is obtained.

Figure 1:
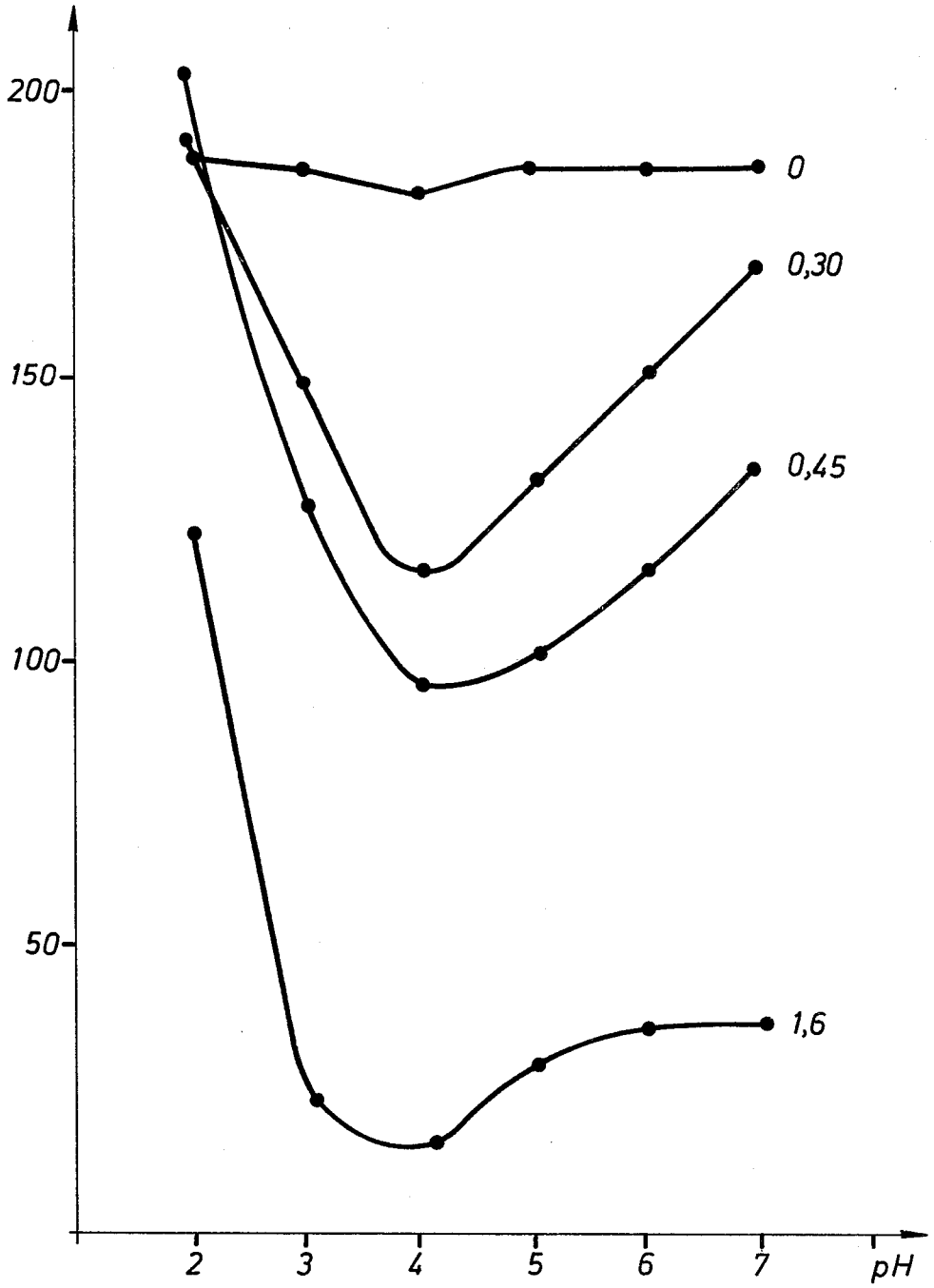
FIG. 1 is a graph of the calcium concentration as a function of pH in the spent sulfite pulping liquor of Example 1.

Suitable polyvalent metal compounds which can be employed to inhibit deposit formation in accordance with the present invention include the hydroxides, sulfates, nitrates, nitrites, sulfites, phosphates, chlorides, acetates, formates, tartrates and oxides. Exemplary aluminum compounds include aluminum sulfate, aluminum hydroxide, aluminum oxide, aluminum chloride and alum, potassium aluminum sulfate, as well as aluminates of various types, such as sodium and potassium aluminates.

Exemplary iron compounds include iron sulfate, sodium ferrate, iron oxide, iron hydroxide, and iron chloride. Both ferric and ferrous iron compounds can be used. The aluminum compounds are preferred under conditions where iron hydroxides or sulfides can be expected to precipitate.

Mixtures of iron and aluminum compounds afford the advantages of each, and are complementary.

The compound can be added to the system as the solid compound or in an aqueous solution or slurry. It is convenient usually to dissolve or disperse the compound in a portion of the liquor, and then blend this in the liquor.

The amount of polyvalent metal complexing compound that is added is sufficient to inhibit the formation of deposits throughout the cellulose pulping or cellulose pulp treating process. An amount within the range from about 0.001% to about 0.1% by weight of the dry lignocellulosic material (wood) is usually sufficient. The amount need not exceed 0.15%, and the preferred amount is from about 0.002% to about 0.05%.

The polyvalent metal complexing compound, and particularly the aluminum compounds and iron compounds, once introduced into the pulping or treating system follow the other inorganic chemicals in the recovery cycle, and consequently the amount that needs to be added is only that to replenish that lost in the course of the recovery process. Thus, a suitable polyvalent metal concentration can be maintained in the system by addition from time to time of the small amount of compound required to replace that lost in the course of the processing. The polyvalent metal will circulate through the system, and will be present at every stage, with the result that deposit formation is inhibited at every stage of the process, and the system seldom needs to be shut down for cleaning.

Thus, the addition of the polyvalent metal compounds in accordance with the invention involves no increase in pollution, nor any special handling problems. Moreover, the polyvalent metal compounds which can be added are inexpensive, and readily available. Thus, the result is a reduction in production costs, because of the elimination of the cleaning problem.

The following Examples in the opinion of the inventors represent preferred embodiments of the invention:

EXAMPLE 1

This Example illustrates application of the process of the invention to the sulfite pulping process.

The solubility of calcium oxalate in spent sulfite pulping liquor at 80° C. over the pH range from about 2 to about 7 was determined using spent sulfite pulping liquor from the Domsjo sulfite mill at Domsjo, Sweden. The test samples were filtered to remove solid particles, fibers, and similar material; sodium oxalate was then added to the test samples, following which the pH was adjusted by addition of HCl or NaOH to the desired pH for the test. Equilibrium was then established by holding the liquor for one hour at 80° C., after which the solution was filtered to remove the precipitate of calcium oxalate formed.

EDTA (ethylene diamine tetraacetic acid) was then added to the test sample, and the calcium content of the spent sulfite pulping liquor determined. The addition of EDTA was made in order to form calcium EDTA complexes, and thereby prevent further precipitation of calcium oxalate. Since the oxalate content of the spent sulfite pulping liquor is comparatively low, it was necessary to add sodium oxalate to the liquor to obtain a sufficient concentration for observation.

The results of the test series with three different additions of sodium oxalate are evident from Table I and are shown in FIG. 1, which represents a graph of the calcium concentration as a function of pH.

TABLE I

| pH | Sodium oxalate added as $C_2O_4^{2-}$ mg/l | $Ca^{2+}$ mg/l | pH | Sodium oxalate added as $C_2O_4^{2-}$ mg/l | $Ca^{2+}$ mg/l |
|---|---|---|---|---|---|
| 2 | 0 | 189 | 5 | 0 | 187 |
| 2 | 125 | 192 | 5 | 125 | 136 |
| 2 | 185 | 203 | 5 | 185 | 102 |
| 2 | 660 | 124 | 5 | 660 | 29 |
| 3 | 0 | 187 | 6 | 0 | 187 |
| 3 | 125 | 149 | 6 | 125 | 153 |
| 3 | 185 | 127 | 6 | 185 | 116 |
| 3 | 660 | 21 | 6 | 660 | 35 |
| 4 | 0 | 183 | 7 | 0 | 187 |
| 4 | 125 | 114 | 7 | 125 | 170 |
| 4 | 185 | 95 | 7 | 185 | 133 |
| 4 | 660 | 15 | 7 | 660 | 36 |

This gives an indirect measure of the solubility of the calcium oxalate in the test sample of spent sulfite pulping digestion liquor. The quotient of the added amount of oxalate and the stoichiometrically equivalent amount of oxalate required for precipitation of calcium oxalate has been marked on the righthand side of the curve in FIG. 1.

Thus, for instance, the quotient 1.6 means that 660 mg of oxalate per liter has been added to the spent liquor in addition to the amount originally present. The existing calcium content in the spent liquor was about 200 mg per liter, before pH adjustment.

As is evident from the uppermost curve in the Figure, which represents the test in which no oxalate was added, one obtains a minimum calcium content at a pH of about 4, which indicates that calcium oxalate has been precipitated at that pH. When the pH exceeds 4, the calcium content gradually increases.

This relationship is influenced by the substances present in spent sulfite pulping liquor, which form complexes with calcium, such as the aldonic acids. The formation of calcium aldonic acid complex is low at the normal pH of the spent pulping liquor, but the amount increases with increasing pH. The solubility curve of calcium oxalate therefore must have a minimum at a given pH.

From the curves resulting from these tests, it is evident that this minimum is at about pH 4. This coincides with experience from the Domsjo sulfite mill, that the deposit problems are most serious when the pH of the spent liquor is within the range from about 4 to about 5.

The capability of aluminum cation to inhibit deposit formation of calcium oxalate in this spent sulfite pulping liquor at varying pH's is shown by the following series of tests, carried out using aluminum chloride as the source of aluminum cation.

The tests were carried out in the same manner as the test procedure above, except that aluminum chloride was added, and the addition of oxalate was kept constant at 1.6 times the amount of oxalate stoichiometrically equivalent to the calcium content in the spent liquor.

Figure 2:
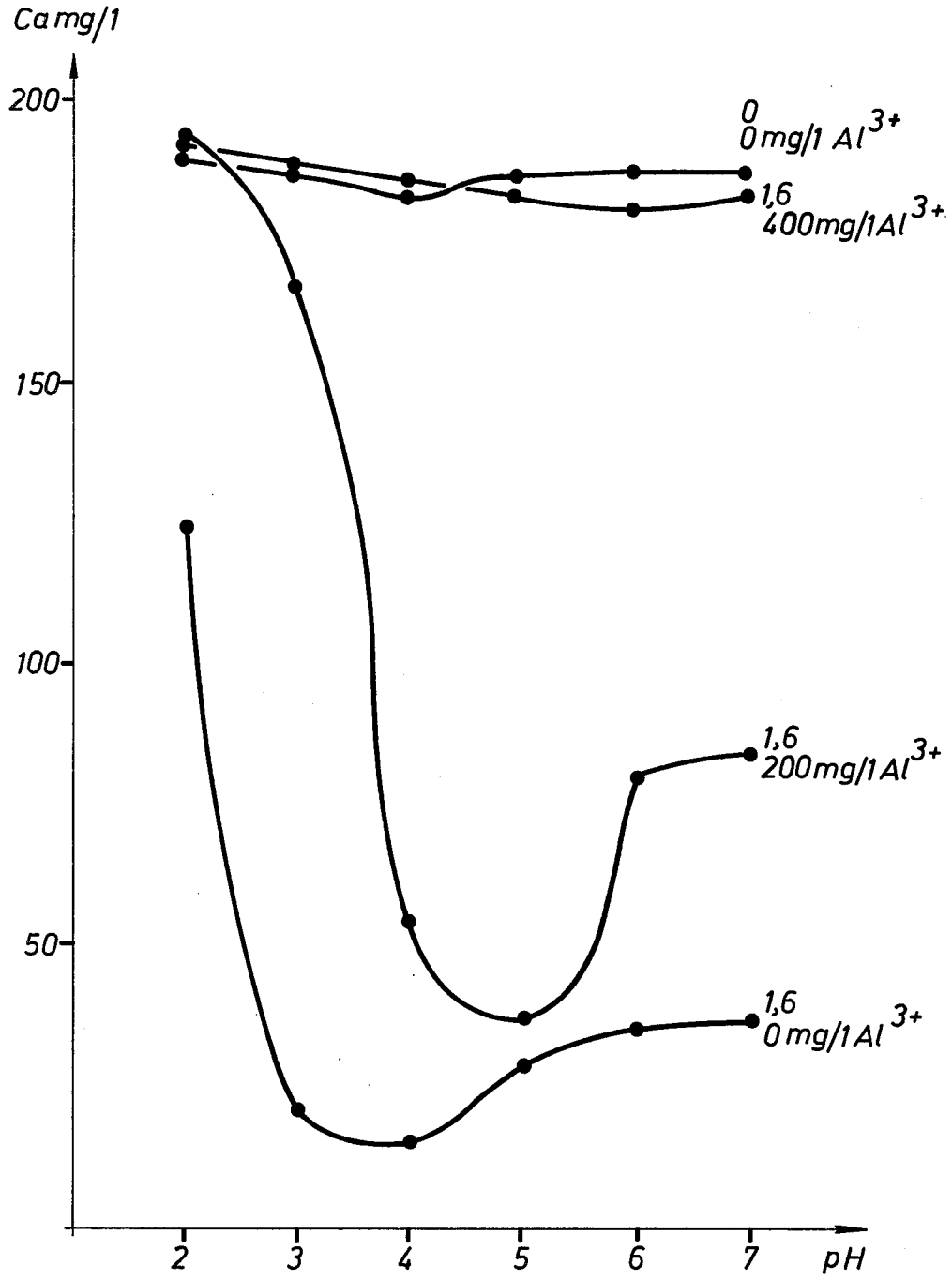
FIG. 2 is a graph of the calcium concentration as a function of pH of the same liquor of Example 1, to which aluminum cation has been added in accordance with the invention.

The test results are shown in Table II and in FIG. 2 in which the calcium concentration in the test samples of spent liquor after addition of aluminum cation is represented as a function of pH.

TABLE II

| pH | Sodium oxalate added as $C_2O_4^{2-}$ mg/l | $Ca^{2+}$ mg/l | pH | Sodium oxalate added as $C_2O_4^{2-}$ mg/l | $Ca^{2+}$ mg/l |
|---|---|---|---|---|---|
| 2 | 0 | 189 | 5 | 0 | 187 |
| 2 | 660 | 191 | 5 | 660 | 184 |

TABLE II-continued

| pH | Sodium oxalate added as $C_2O_4^{2-}$ mg/l | $Ca^{2+}$ mg/l | pH | Sodium oxalate added as $C_2O_4^{2-}$ mg/l | $Ca^{2+}$ mg/l |
|---|---|---|---|---|---|
| 2 | 660 | 193 | 5 | 660 | 37 |
| 2 | 660 | 124 | 5 | 660 | 29 |
| 3 | 0 | 187 | 6 | 0 | 187 |
| 3 | 660 | 188 | 6 | 660 | 181 |
| 3 | 660 | 167 | 6 | 660 | 82 |
| 3 | 660 | 21 | 6 | 660 | 35 |
| 4 | 0 | 183 | 7 | 0 | 187 |
| 4 | 660 | 186 | 7 | 660 | 184 |
| 4 | 660 | 52 | 7 | 660 | 85 |
| 4 | 660 | 15 | 7 | 660 | 36 |

The curves in FIG. 2 show that the calcium content of the spent sulfite pulping liquor increases when aluminum is added. This means that the calcium is retained in solution rather than precipitated. At the rather high aluminum content of about 400 mg/liter, negligible precipitation of calcium oxalate results, showing that when the aluminum concentration is sufficiently high, calcium oxalate precipitation is completely inhibited.

This amount is atypical, because the oxalate content in the test samples was artificial, it having been necessary to increase the oxalate concentration in order to obtain a result which could be observed during the experiment. In spent sulfite pulping liquor, the oxalate content can be expected to be within the range from about 10 to about 30 mg/liter, which means that, practically speaking, the formation of deposits can be entirely prevented by the use of considerably less aluminum than 400 mg/liter, of the order of from 3 to 50 mg/liter. Due to analytical difficulties the actual concentration of oxalate in the spent pulping liquor could not be determined.

EXAMPLE 2

A further series of tests was carried out with spent sulfite pulping liquor, using varying additions of aluminum chloride, in accordance with the procedure described in Example 1. In these tests, the pH was adjusted to 4, at which pH calcium oxalate has its lowest solubility in the spent sulfite pulping liquor. The temperature of the test was 80° C., and the oxalate addition was 660 mg/liter in all tests.

Figure 3:
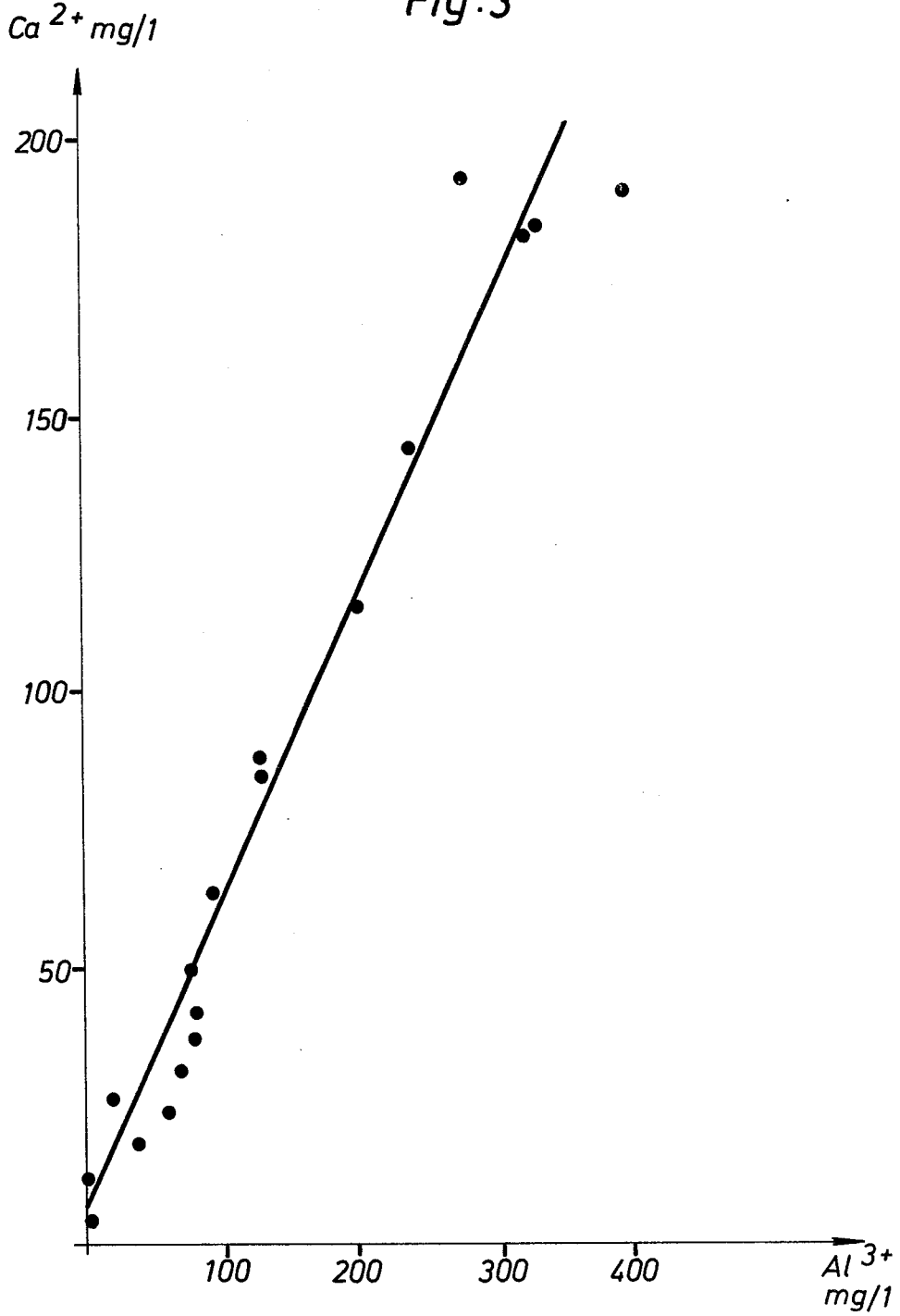
FIG. 3 is a graph of the calcium content of the spent pulping liquor of Example 2, as a function of the addition of aluminum cation.

The results of the tests are shown in Table III, corresponding to FIG. 3, in which the calcium content of the test samples is represented as a function of the addition of aluminum cation.

TABLE III pH: 4. Temperature: 80° C.
Added amount sodium oxalate: 660 mg/l (as $C_2O_4^{2-}$)

| $Al^{3+}$ added mg/l | Amount of $Ca^{2+}$ in solution mg/l | $Al^{3+}$ added mg/l | Amount of $Ca^{2+}$ in solution mg/l |
|---|---|---|---|
| 0 | 5 | 95 | 63 |
| 0 | 12 | 130 | 84 |
| 20 | 26 | 130 | 87 |
| 40 | 18 | 200 | 115 |
| 60 | 24 | 240 | 144 |
| 70 | 31 | 280 | 193 |
| 75 | 49 | 330 | 183 |
| 80 | 37 | 340 | 185 |
| 80 | 41 | 400 | 191 |

From the Figure, it is apparent that the solubility of calcium oxalate increases as the addition of aluminum cation increases, and that the relationship is linear over the pH range investigated. From the slope of the curve, a simple calculation shows that 11 mg of aluminum cation corresponds to about 5 mg of calcium cation, i.e., that this amount of aluminum cation will prevent precipitation of this amount of calcium as calcium oxalate.

EXAMPLE 3

The Example shows the effectiveness of the process of the invention in a continuous sulfite pulping process, with recycling of the spent liquor for chemicals recovery. The tests were carried out directly on spent sulfite pulping liquor sampled from the Domsjo sulfite mill, by diverting a fraction of the flow of fresh pulping liquor at 1, dividing this at 2 into two streams A, B, which flowed through removable test pipes 6, 7, respectively, for observation of deposit formation.

Figure 4:
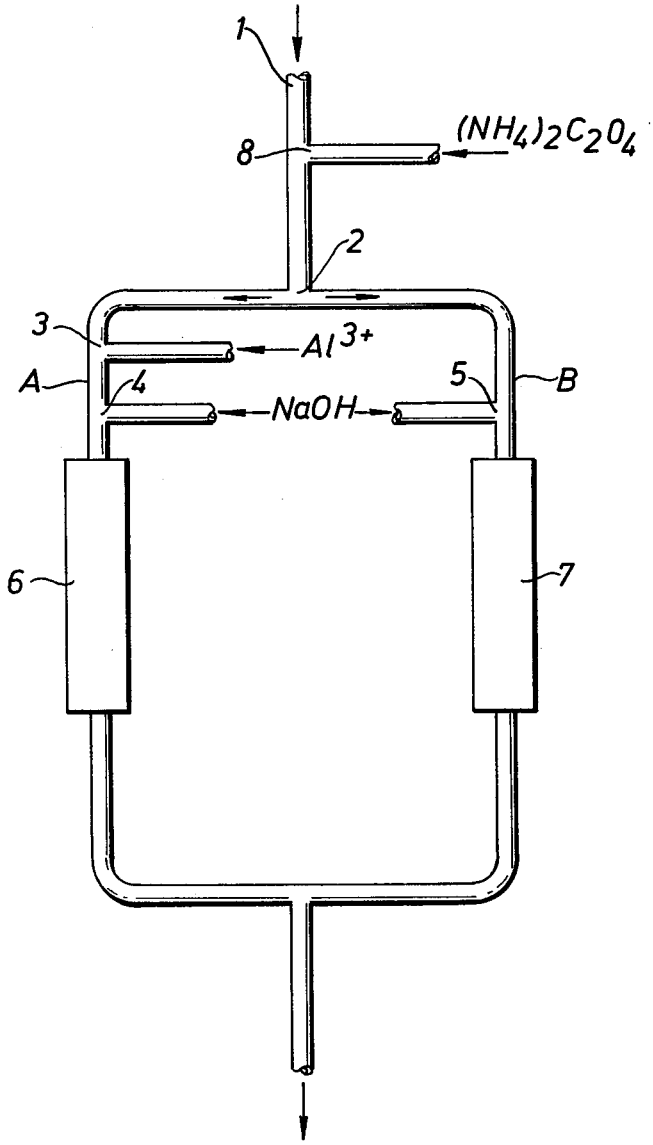
FIG. 4 is a flow sheet showing an experiment performed in a continuous sulfite pulping process utilizing the process of the invention.

The stream of spent pulping liquor coming in at 1 of FIG. 4 had a pH of about 2 to 2.5, and was adjusted to a flow of 2 liters/minute by means of a flow-regulating valve (not shown in the Figure). The two streams A and B each had a flow of 1 liter/minute. At 3, an aluminum compound (aluminum chloride) was added to stream A, in an amount to give an aluminum cation content in the stream of about 20 mg/liter. No addition of aluminum was made to stream B. At 4 and 5, sodium hydroxide was added to each of streams A and B, in such an amount that a pH of about 5 was obtained in each stream.

After flow had continued for several days, flow was stopped, and the two steel pipes 6 and 7 were removed for observation of a precipitate, if any. However, no precipitate could be detected in the pipes, from which it was apparent that the oxalate content of the spent pulping liquor had been too low to result in precipitate formation. Accordingly, ammonium oxalate was added to the spent liquor stream at 8, and flow was resumed after replacement of the pipes. The amount of oxalate was adjusted so that a concentration of 100 mg of oxalate anion/liter was obtained in the spent liquor.

Figure 7:
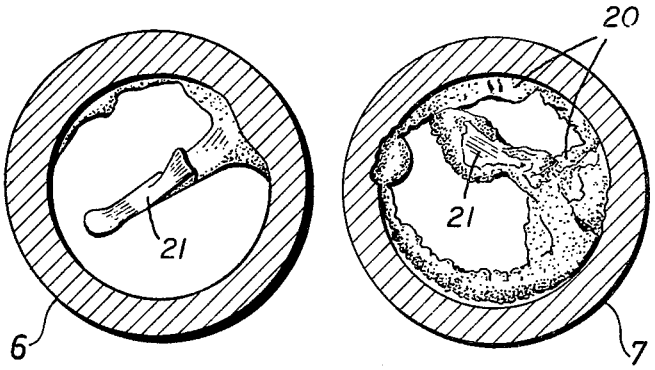
FIG. 7 is a cross-sectional view of the pipes 6,7 of FIG. 4 after the system had been operated one day under the conditions of Example 3.

The spent liquor was allowed to flow through the system for twenty-four hours, after which flow was again stopped, and the pipes 6 and 7 again removed for observation. It was now found that a heavy deposit 20 of calcium oxalate had been obtained in pipe 7, through which stream B had been flowing; the other pipe 6, through which stream A had been flowing, containing the addition of aluminum cation, was totally free from deposits. This is apparent from FIG. 7, which is a photograph of a cross-section cut through each pipe. An IR spectographic analysis of the deposit in pipe 7 showed that it was calcium oxalate. The tongue-like details 21 (particularly well visible in the cross-section cut of pipe 6) are static mixers fastened in the pipes in order to achieve a good stirring of the flow.

This test shows clearly that a dosage of aluminum cation in accordance with the invention inhibits the formation of calcium oxalate deposits in continuous-flow sulfite pulping systems, and that the process is of practical application to inhibit the formation of such deposits. Only a relatively moderate amount of aluminum cation is required. In this case, 20 mg/liter gave a complete inhibition of calcium oxalate formation.

EXAMPLE 4

Figure 5:
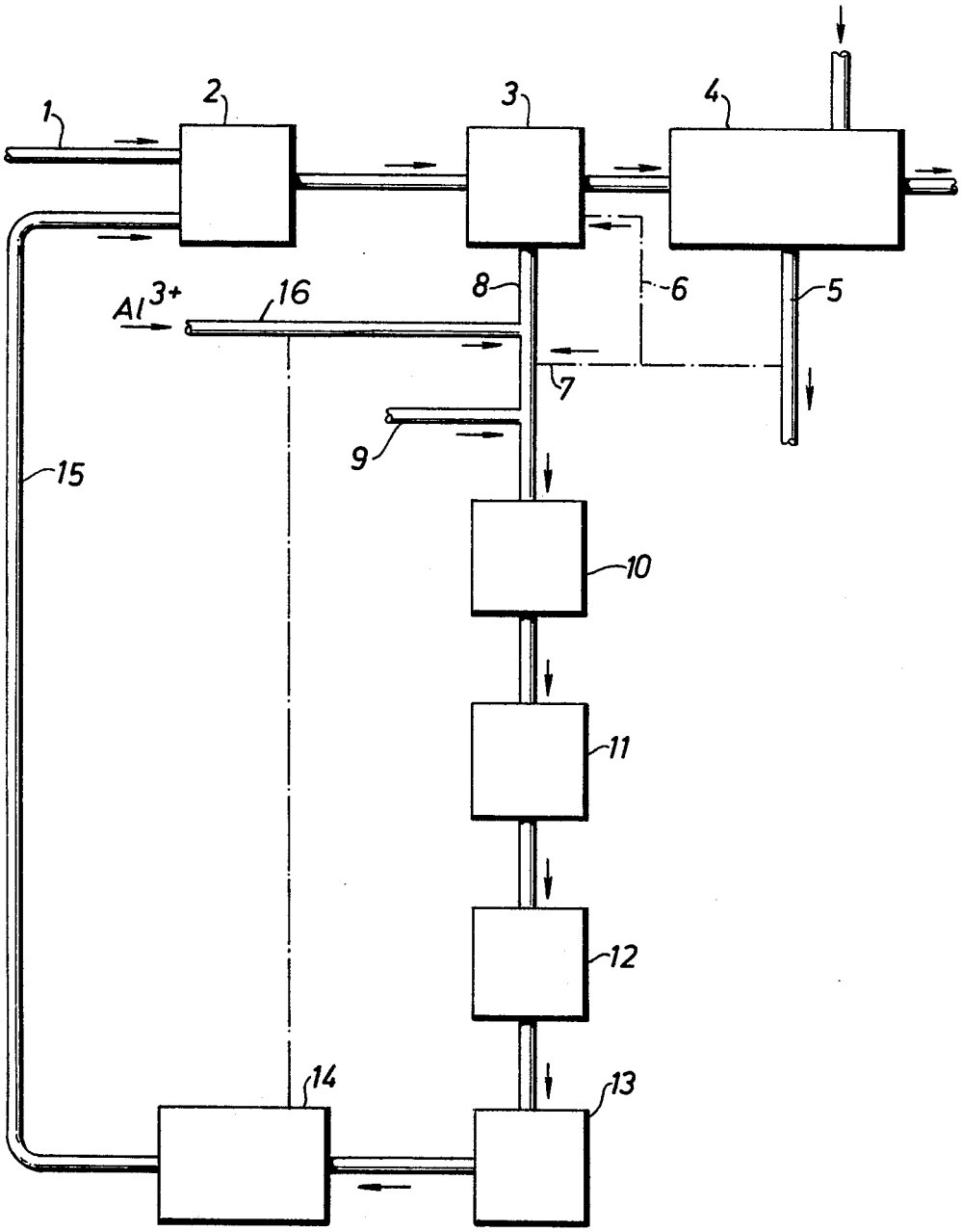
FIG. 5 is a flow sheet showing a continuous sulfite pulping process, utilizing the process of the invention.

This Example illustrates the application of the process of the invention to a mill scale run at the Domsjo sulfite mill in Domsjo, Sweden. A schematic representation of the various stages of the sulfite pulping process used in this mill appears in FIG. 5.

Washed wood chips are fed via line 1 to the digester 2, from which cellulose pulp is obtained, and fed to the washing section 3 for washing, and from there to the bleaching section 4 for three-stage bleaching. Spent bleaching liquor passes through line 5, and a part 6 of the spent bleaching liquor in line 5 is recycled and used for countercurrent washing in the washing section 3. Another part of the spent bleaching liquor is returned via line 7 directly to the spent digestion liquor, line 8.

The spent pulping liquor in line 8 on its way to the chemicals recovery stage is first subjected to a pH adjustment to about 4.5 by addition of adjusting chemicals via line 9, after which the pulping liquor is pre-evaporated in a Lockman evaporation column 10. The pre-evaporated spent pulping liquor then passes to the alcohol section 11, for recovery of fermentable hexoses in the liquor. The fermented spent sulfite liquor coming from the alcohol section 11 is further evaporated in a final evaporator 12, and combusted in the boiler 13.

The smelt from the soda boiler is then passed to the vessel 14, where the pulping chemicals are prepared according to the STORA process, and the regenerated pulping liquor thus obtained is fed through the line 12 to the digester 2. The recovery is carried out in accordance with the STORA process, *Svensk Papperstidning* 79:18 591–594 (1976).

Normally, a most troublesome formation of calcium oxalate deposits occurs in the Lockman evaporator column 10. Consequently, this column has to be taken out of service and cleaned out at regular intervals. The presence of a significant amount of deposit in the Lockman evaporator column is manifested by an increase in the pressure drop from beginning to end of the column, and very often the pressure drop shows an increase within one day after cleaning has been carried out.

In the mill scale tests of this Example, a solution of aluminum sulfate was continuously added to the spent pulping liquor via inlet line 15, in such an amount that the aluminum ion concentration in the spent sulfite pulping liquor in line 8 was maintained at about 30 mg/liter throughout the operation.

The system was operated with this addition of aluminum for one week. At the end of this time, no formation of calcium oxalate deposit or clogging in the pre-evaporator column 10 could be observed.

The amount of aluminum sulfate solution added was then decreased, so that the aluminum cation content in the spent pulping liquor was about 5 mg/liter. The test was then continued for another 28 days, but still no noticeable deposit formation was observed in the Lockman evaporator column 10.

Thus, the addition of aluminum cation in accordance with the invention to spent sulfite pulping liquor before its neutralization and evaporation prevents deposit formation.

The neutralization makes possible a desirable decrease in the acetic acid content in the condensate. Acetic acid is bound in the form of acetate, and the acetate follows the spent liquor. Consequently, the amount of acetic acid in the condensate is correspondingly reduced. This means that the amount of biological/oxygen degradable substances in the condensate is decreased from 35 kg to 12 kg/ton of pulp. Several advantages are thus obtained with the process of the invention, since the desirable neutralization of the spent liquor to a pH of about 4.5 to 5.0 has earlier always resulted in troublesome and expensive formation of deposits in especially the pre-evaporator column 10.

The fact that the addition of aluminum could be decreased from 30 mg aluminum/liter to 5 mg aluminum/liter without the formation of any deposit clearly indicates that the aluminum circulates with the other inorganic chemicals in the recovery cycle, and that the aluminum concentration builds up, and is maintained at a sufficient concentration to prevent deposit formation.

On the other hand, the process carried out in the absence of aluminum at a pH of from 4 to 5.5 resulted in the formation of heavy calcium oxalate deposits in the apparatus, and especially in the pre-evaporator apparatus 10.

EXAMPLE 5

In the bleaching of cellulose pulp, a large number of organic compounds are formed, and the oxalic acid content can be as high as 300 to 400 mg/liter oxalate anion in the spent liquor. This is about ten times more than the amount present in spent sulfite pulping liquor. Since the recycling of spent bleaching liquor is now very important, it is apparent that serious deposit problems can arise in the recycling of spent bleaching liquors in the recovery cycle.

In order to study the possibility for the inhibition of deposit formation in the recycling of spent bleaching liquor, the following tests were carried out, using spent bleaching liquors from the bleaching of pine sulfate pulp. Spent liquors from different stages in the bleaching sequence O-C/D-$E_1$-$D_1$-$E_2$-$D_2$ were studied and used in the tests. The abbreviations used in designating the stages of the sequence mean:

O=oxygen bleaching
C/D=bleaching with a mixture of chlorine and chlorine dioxide
E=extraction with alkali
C=chlorine bleaching
D=chlorine dioxide bleaching.

The subscript indicates the number of the stage of several stages used.

To test samples of the spent liquor, calcium was added, both without any preceding pH adjustment and with the pH adjusted to within the range from 4 to 10.

In the test samples from the spent liquor from the stages O, $E_1$ and $E_2$, a precipitate was obtained upon addition of calcium. The precipitate in the spent liquor from the O stage was identified as a mixture of calcium carbonate and calcium oxalate. In the spent liquor from the $E_1$ stage, the precipitate mainly consisted of calcium oxalate. This confirms that the formation of calcium oxalate deposits from these liquors is likely.

On the other hand, when calcium in the same amount was added to test samples of the spent bleaching liquor containing aluminum, no calcium oxalate precipitate was formed. In these tests, the aluminum concentration was within the range from about 20 to about 200 mg Al/liter.

Figure 6:
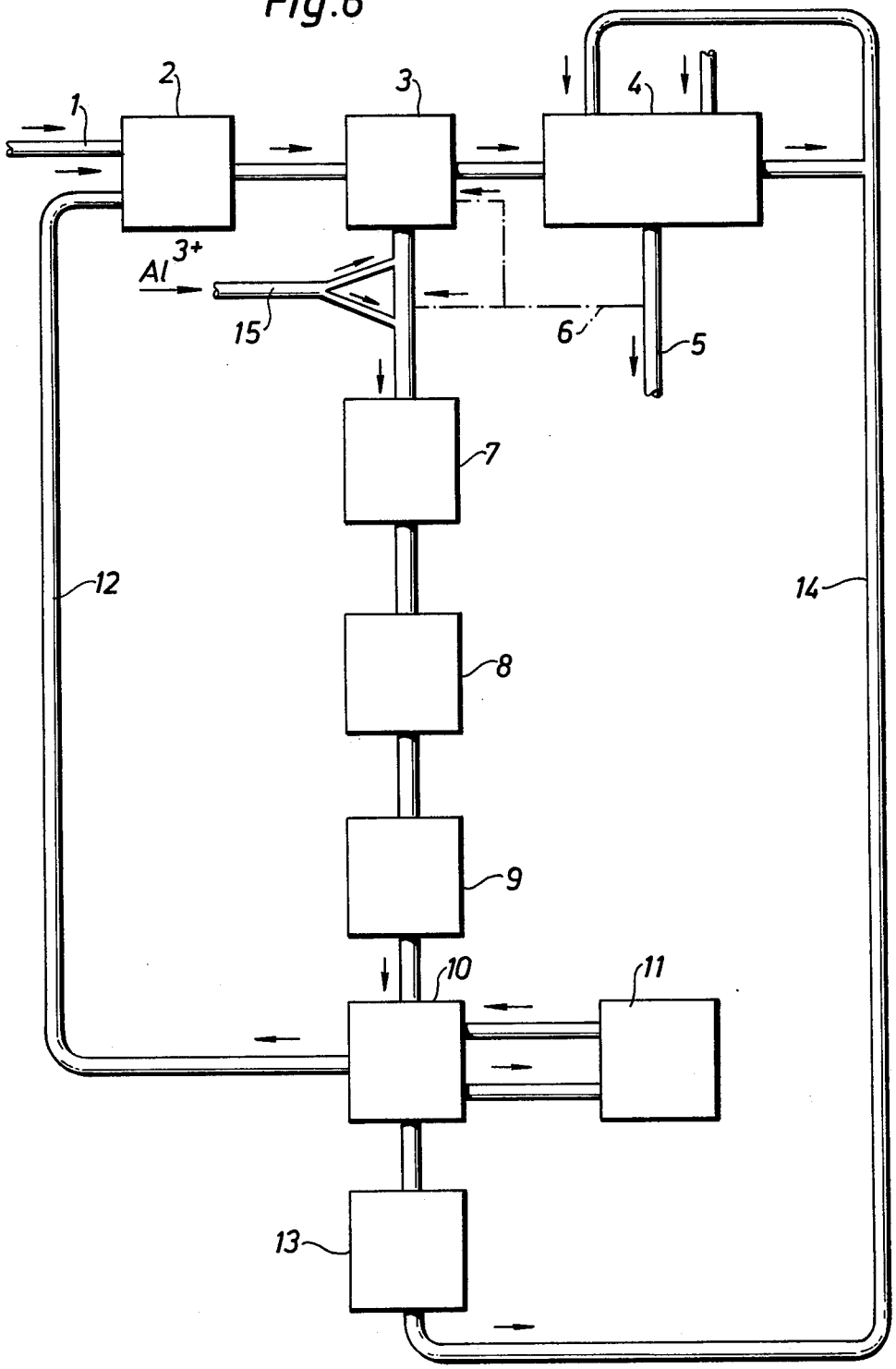
FIG. 6 is a flow sheet showing a continuous sulfate pulping process utilizing the process of the invention.

FIG. 6 is a flow sheet showing the sequence of stages in a conventional sulfate pulping mill. The wood chips enter at line 1 and are fed to the digester 2, and then proceeds to the washing and screening stage 3, whence the pulp is fed to the bleaching stage 4 while black liquor proceeds to the chemicals recovery stages via line 18.

An aluminum compound, such as aluminum sulfate or aluminum chloride, is added to the black liquor via line 15. The aluminum thus added will follow the black liquor through the evaporation stage 7 to the soda boiler 8. Aluminum will also be carried with the smelt from the boiler 8 in the flow of chemicals through the dissolver 9 and the causticization stage 10 to the white liquor, which is recycled through the line 12 to the digester 2. The white liquor contains aluminum in the form of aluminate ions, and the aluminum will thus be circulating through the entire pulping system.

In alkaline-oxygen bleaching, very often oxidized white liquor is used as the source of alkali in the oxygen bleaching stage. This is also the case in the sulfate mill shown in FIG. 6. The white liquor is taken out from the causticization stage 10 and oxidized at stage 13, whence it is carried via line 14 to the bleaching stage 4. The oxidized white liquor also contains aluminum. By using oxidized white liquor with aluminum ions in the oxygen bleaching stage, oxalate ions formed in this bleaching stage are bound directly in the bleaching liquor, complexed by the aluminum. In the same way, oxidized white liquor or oxidized green liquor can be used in the alkaline extraction stages, and the aluminum ion will bind the oxalate ions as complex ions in these stages. Upon recovery of the spent bleaching liquor via line 5 and transfer of a part of the spent bleaching liquor through the line 6, either to the washing stage 3 or directly to the black liquor in line 18, the oxalate part of the aluminum oxalate complex when it reaches the soda boiler 8 will be combusted. The oxalate will thus disappear, but the aluminum residue will circulate in the chemicals recovery system, and thus be reused in due course.

If the aluminum content in the oxidized white liquor is found to be too low, aluminum can be added to some or all of the bleaching stages in the bleaching sequence. The addition of aluminum must however be appropriate to the stage, in order to prevent the formation of precipitates with other chemicals present in bleaching stages.

While Example 5 shows that the bleaching sequence O-C/D-$E_1$-$D_1$-$E_2$-$D_2$ gives rise to oxalate formation, other sequences also give rise to oxalate formation. In fact, oxalic acid is formed in most bleaching stages, and consequently the addition of aluminum, iron, or other polyvalent metal cation to any bleaching stage can be expected to prevent the formation of calcium oxalate precipitates, when such precipitate formation is possible.

In addition to the polyvalent metal compound, it is also possible to add a chelating agent of conventional type, such as EDTA, NTA or DTPA. However, because of the higher cost of these chemicals, their use would usually be avoided, if possible. The process of the invention is applicable to any conventional cellulose pulping process, such as the sulphate pulping process, the sulfite pulping process based on calcium, sodium, magnesium as well as ammonium.

Having regard to the foregoing disclosure, the following is claimed as inventive and patentable embodiment thereof:

1. A process for inhibiting the formation of deposits in cyclic cellulose pulping or cellulose pulp treating processes in which chemicals are recovered from spent liquors and recycled, thereby reducing the need for shutdown of equipment for cleaning, which comprises carrying out the cellulose pulping or cellulose pulp treating in a liquor having dissolved therein an amount within the range from about 0.001% to about 0.15% by weight of the dry lignocellulosic material of aluminum cation capable of forming liquor-soluble complexes with deposit-forming anions and thus retaining the deposit-forming anions in solution in the cellulose pulping or cellulose pulp treating liquor and inhibiting the formation of deposits at every stage of the cyclic process in which such deposits may form, including the chemicals recovery stage by maintaining said aluminum cation in said range throughout the cyclic process.

2. A process in accordance with claim 1 in which an aluminum compound is added to spent pulping liquor in an amount to provide a sufficient quantity of complexing aluminum cation in the liquor so that the deposit-forming anions are kept in solution in the form of a liquor-soluble complex with the aluminum cation.

3. A process in accordance with claim 1, in which the aluminum cation is added as a compound selected from the group consisting of aluminum potassium sulfate, aluminum hydroxide, aluminum oxide, aluminum chloride, aluminum sulfate, sodium aluminate, and potassium aluminate.

4. A process in accordance with claim 1, in which the polyvalent metal cation is a mixture of iron and aluminum.

5. A process in accordance with claim 1, in which the aluminum cation is added as a polyvalent metal compound to spent sulfite pulping liquor to inhibit deposit formation in the chemicals recovery stage of the sulfite process.

6. A process in accordance with claim 1, in which the aluminum cation is added as a polyvalent metal compound to spent sulfate pulping liquor to inhibit deposit formation in the chemicals recovery stage of the sulfate process.

7. A process in accordance with claim 1, in which the aluminum cation is added as a polyvalent metal compound to spent soda pulping liquor to inhibit deposit formation in the chemicals recovery stage of the soda process.

8. A process in accordance with claim 1, in which the aluminum cation is added as a polyvalent metal compound to spent cellulose pulp bleaching liquor to inhibit deposit formation in the chemicals recovery stage of the bleaching process.

9. A process in accordance with claim 1, in which the aluminum cation is added as a polyvalent metal compound to oxidized green liquor to inhibit deposit formation in the chemicals recovery stage of the process.

10. A process in accordance with claim 1, in which the aluminum cation is added as a polyvalent metal compound to oxidized white liquor to inhibit deposit formation in the chemicals recovery stage of the process.

11. A process in accordance with claim 1, in which aluminum is added as an aluminum compound to spent sulfite pulping liquor having a sodium sulfite base; and forming a precipitate of aluminum hydroxide; separating and dissolving the aluminum hydroxide in alkali; and adding the resulting solution to spent pulping liquor before its evaporation.

12. A process in accordance with claim 1, in which the aluminum cation is added as an aluminum compound to spent pulping liquor at a stage at which oxalic acid is formed.

13. A process in accordance with claim 1, in which the aluminum cation is added as a polyvalent metal compound to spent alkaline-oxygen bleaching liquor to inhibit deposit formation in the chemicals recovery stage of the alkaline-oxygen bleaching liquor.

14. A process in accordance with claim 1, in which the aluminum cation is added as an aluminum compound to spent bleaching liquor at a stage in which oxalic acid is formed.

* * * * *

UNITED STATES PATENT AND TRADEMARK OFFICE

CERTIFICATE OF CORRECTION

PATENT NO. : 4,218,284

DATED : August 19, 1980

INVENTOR(S) : Bengt G. Hultman and Rolf C. Nilsson

It is certified that error appears in the above—identified patent and that said Letters Patent is hereby corrected as shown below:

Column 12, line 60 : Omit "a polyvalent metal" and insert -- an aluminum--

Signed and Sealed this

*Thirtieth* Day of *June 1981*

[SEAL]

*Attest:*

RENE D. TEGTMEYER

*Attesting Officer*

*Acting Commissioner of Patents and Trademarks*